US006828850B2

(12) United States Patent
LeChevalier

(10) Patent No.: US 6,828,850 B2
(45) Date of Patent: Dec. 7, 2004

(54) METHOD AND SYSTEM FOR CHARGE PUMP ACTIVE GATE DRIVE

(75) Inventor: Robert LeChevalier, Golden, CO (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 126 days.

(21) Appl. No.: 10/274,488

(22) Filed: Oct. 17, 2002

(65) Prior Publication Data

US 2003/0137341 A1 Jul. 24, 2003

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,791, filed on Oct. 19, 2001, provisional application No. 60/343,370, filed on Oct. 19, 2001, provisional application No. 60/342,783, filed on Oct. 19, 2001, and provisional application No. 60/342,794, filed on Oct. 19, 2001.

(51) Int. Cl.[7] ..... G05F 3/02
(52) U.S. Cl. ..... 327/536; 363/60
(58) Field of Search ..... 327/536; 363/59, 363/60; 307/110

(56) References Cited

U.S. PATENT DOCUMENTS 4,236,199 A * 11/1980 Stewart ..... 363/60
4,603,269 A 7/1986 Hochstein
RE32,526 E 10/1987 Hochstein
5,162,668 A 11/1992 Chen et al.
5,514,995 A 5/1996 Hennig ..... 327/399
5,672,992 A 9/1997 Nadd
5,689,208 A 11/1997 Nadd
6,201,717 B1 3/2001 Grant

FOREIGN PATENT DOCUMENTS

| | | |
|---|---|---|
| EP | 1 081 836 A2 | 3/2001 |
| GB | 2 239 638 A | 2/2000 |
| JP | 59097223 | 6/1984 |
| JP | 4-172963 | 6/1992 |
| JP | 7322605 | 12/1995 |
| JP | 11-330376 | 11/1999 |

* cited by examiner

*Primary Examiner*—Kenneth B. Wells
(74) *Attorney, Agent, or Firm*—Knobbe Martens Olson & Bear LLP

(57) ABSTRACT

A circuit for increasing the voltage/current level of a signal to drive a power transistor from a low voltage input. The gate drive circuit comprises a voltage multiplier for increasing the voltage level of a low voltage input signal, a level shifter for shifting the voltage level of a logic signal to a level relative to a voltage signal produced by the voltage multiplier, and a source follower, connected to the level shifter, for increasing the current of the increased voltage, level shifted output signal of the level shifter. The resulting multiplied, shifted, and increased current signal can be used to drive a power transistor.

38 Claims, 2 Drawing Sheets

METHOD AND SYSTEM FOR CHARGE PUMP ACTIVE GATE DRIVE

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001 entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES";

U.S. patent application Ser. No. 10/141,650 entitled "CURRENT BALANCING CIRCUIT", filed May 7, 2002;

U.S. patent application Ser. No. 10/141,325 entitled "CURRENT BALANCING CIRCUIT", filed May 7, 2002;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141,659, filed on May 7, 2002, entitled "MATCHING SCHEME FOR CURRENT CONTROL IN SEPARATE I.C.S.";

U.S. patent application Ser. No. 10/141,326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. patent application Ser. No. 10/274,429 entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith U.S. patent application Ser. No. 10/274,428 entitled "METHOD AND CLAMPING APPARATUS FOR SECURING A MINIMUM REFERENCE VOLTAGE IN A VIDEO DISPLAY BOOST REGULATOR", filed on even date herewith;

U.S. patent application Ser. No. 10/141,648, filed May 7, 2002, entitled "APPARATUS FOR PERIODIC ELEMENT VOLTAGE SENSING TO CONTROL PRECHARGE";

U.S. patent application Ser. No. 10/141,318, filed May 7, 2002, entitled "METHOD FOR PERIODIC ELEMENT VOLTAGE SENSING TO CONTROL PRECHARGE,";

U.S. patent application Ser. No. 10/274,489 entitled "MATRIX ELEMENT PRECHARGE VOLTAGE ADJUSTING APPARATUS AND METHOD", filed on even date herewith;

U.S. patent application Ser. No. 10/274,491 entitled "SYSTEM AND METHOD FOR EXPOSURE TIMING COMPENSATION FOR ROW RESISTANCE", filed on even date herewith;

U.S. patent application Ser. No. 10/274,421 entitled "METHOD AND SYSTEM FOR PRECHARGING OLED/PLED DISPLAYS WITH A PRECHARGE LATENCY", filed on even date herewith;

U.S. Provisional Application 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. patent application Ser. No. 10/274,513 entitled "ADAPTIVE CONTROL BOOST CURRENT METHOD AND APPARATUS", filed on even date herewith;

U.S. patent application Ser. No. 10/274,490 entitled "PREDICTIVE CONTROL BOOST CURRENT METHOD AND APPARATUS", filed on even date herewith;

U.S. patent application Ser. No. 10/274,500 entitled "RAMP CONTROL BOOST CURRENT METHOD", filed on even date herewith;

U.S. patent application Ser. No. 10/274,511 entitled "METHOD AND SYSTEM FOR ADJUSTING PRECHARGE FOR CONSISTENT EXPOSURE VOLTAGE", filed on even date herewith;

U.S. patent application Ser. No. 10/274,502 entitled "METHOD AND SYSTEM FOR RAMP CONTROL OF PRECHARGE VOLTAGE", filed on even date herewith.

BACKGROUND OF THE INVENTION

1. Field of the Invention

The invention relates generally to low voltage power conversion, and more particularly to power conversion in digital circuits.

2. Description of the Related Art

Information display screens typically use rows of light emitting devices to display a desired image or compilation of data. The light emitting devices generally require large current sources so that the demand may be met in the event that all the devices must "light up" at the same time. Satisfying this need is a problem in portable or handheld devices wherein the amount of current or power available is limited by the size of the current or power generator. To address this problem, small power supplies are typically used in combination with power conversion circuits, or boost regulators in the display device. These boost regulators include several transistors which require a certain level of gate drive voltage for operation. The required voltage level is sometimes higher than that supplied directly by the power source of the device.

Some display drive applications require operating power from a single, low-voltage battery where, for power conversion efficiency, the high voltage supply should be generated directly from the battery voltage. A disadvantage of using a battery with a voltage output of 2.7 volts or less, such as lithium ion batteries, is that the high voltage switching transistors employed in the conversion process cannot be driven by such batteries with a high enough control voltage so as to achieve low on-resistance and acceptable power conversion efficiency. One solution to the problem of inadequate gate drive voltage is to increase the size of the switching transistor of the conversion circuit. However, this increases the losses and the monolithic die size for the conversion circuit. If the switching transistor is a discrete device such as a power MOSFET, separate from the control circuitry, the inadequate gate drive increases the size and cost of this component.

In view of the above, it will be appreciated that an appropriate apparatus and method for increasing the voltage supply level while minimizing losses and maintaining an effective die size would be beneficial to power conversion circuits operating from low voltage power sources.

SUMMARY OF THE INVENTION

A device for increasing the voltage and current level of a low voltage input signal and a logic signal. The device comprises a voltage multiplier configured to increase the level of a first voltage input signal so as to define a multiplied voltage signal, a level shifting circuit configured to shift a low voltage level of the logic signal to that of the multiplied voltage signal to produce a shifted, multiplied voltage signal, and a device, connected to a second voltage power source and responsive to the shifted, multiplied voltage signal, and configured to increase the current level of the shifted, multiplied voltage signal. In one embodiment, the device for increasing the current level of the shifted, multiplied voltage signal can be a source follower MOSFET. The device for increasing the voltage and current level may be configured to drive a gate of a power switching transistor. Furthermore, the voltage multiplier of the device may be a diode tripler.

One feature of the invention relates to method of increasing the voltage level and current level of a low voltage logic signal using a first voltage source. The method comprises multiplying a first voltage signal from said first voltage source to produce a multiplied voltage signal, and shifting said low voltage logic signal to the voltage level of said multiplied voltage signal. The method may also further comprise increasing the current of said shifted, multiplied voltage signal, by use of a bootstrap connection to a second voltage source.

Another aspect of the invention concerns a method of providing a gate drive voltage to a power transistor from a low voltage input. The method comprises providing a switching control input and multiplying said low voltage input using said switching control input, a diode tripler, and at least one capacitor. The method further comprises level shifting said multiplied low voltage input using said switching control input, and bootstrapping a high voltage switching power supply to a source follower. The method may further comprise providing a first current to said source follower, and providing a second current from said source follower to said power transistor.

BRIEF DESCRIPTION OF THE DRAWINGS

These and other objects and features of the invention will become more apparent from the following description and appended claims taken in conjunction with the following drawings, wherein like reference numbers indicate identical or functionally similar elements.

DETAILED DESCRIPTION OF THE INVENTION

The following is a detailed description of embodiments of the invention. However, the invention can be embodied in a multitude of different ways as defined by the claims. The invention is more general than the embodiments that are explicitly described, and accordingly, is not limited by the specific embodiments.

Figure 1:
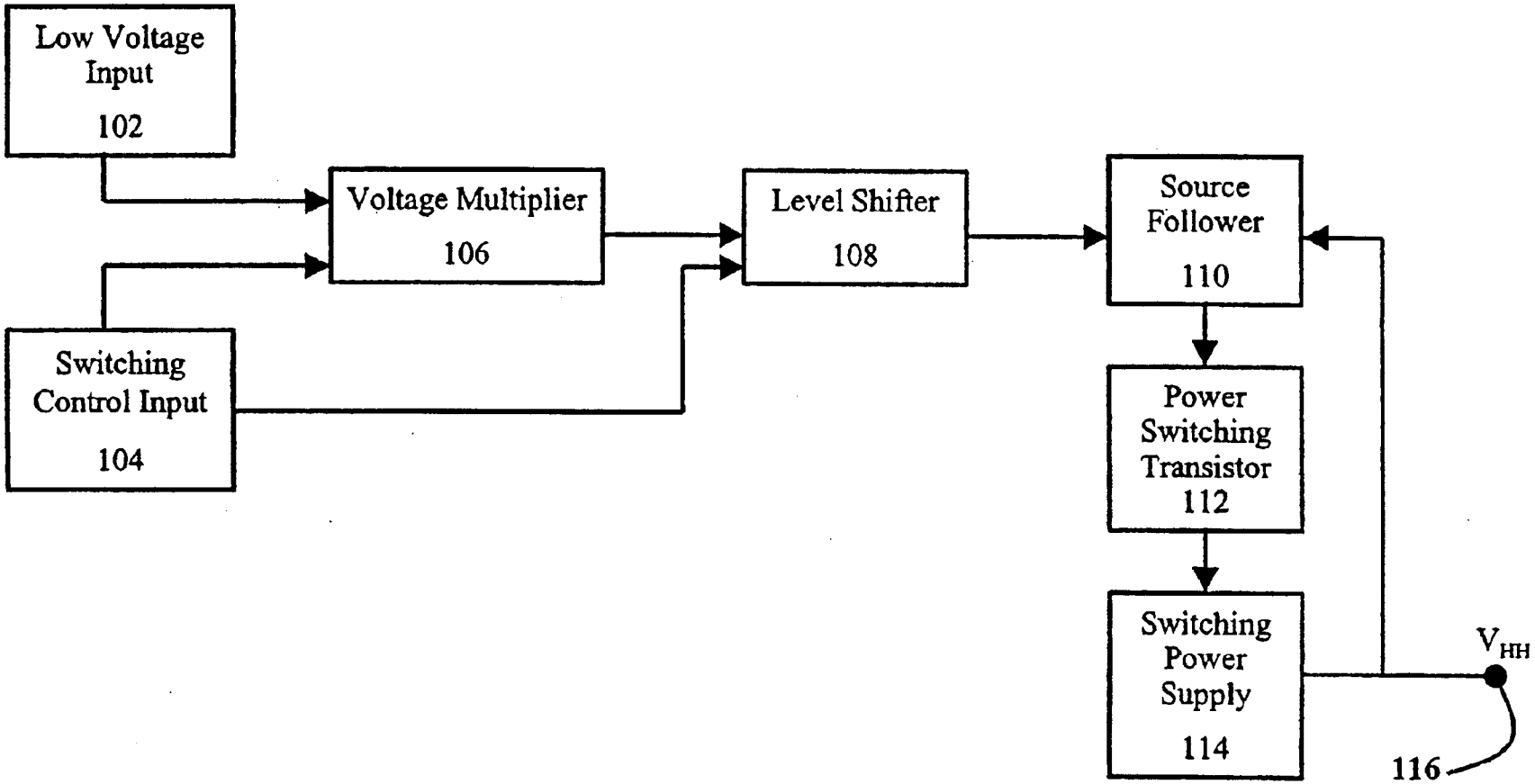
FIG. 1 is a block diagram of a charge pump active gate drive in accordance with the invention.

The invention is directed to a charge pump active gate drive circuit which converts a low input voltage, such as that produced by a lithium ion battery at about 2.7 Volts, to a higher voltage to drive at least one switching transistor. Referring initially to FIG. 1, in one embodiment it is seen that the gate drive circuit comprises a low-voltage input 102 and a switching control input 104, such as a clock input, connected to a voltage multiplier 106. It will be appreciated that the term voltage multiplier can refer to any type of apparatus for increasing the voltage level of a signal. The switching control input 104 can be a logic signal such as a clock signal, or, more specifically, an output signal from a D-type flip flop responsive to a signal from the low-voltage input 102 and a clock.

The gate drive circuit also comprises a level shifter 108 connected to the output of the voltage multiplier 106 and the switching control input 104. The output of the level shifter 108 is connected to an input of a source follower 110, whose output is connected to an input of a switching transistor 112. The output of the switching transistor 112 is connected to the input of a switching power supply 114. The switching power supply 114 produces an output $V_{HH}$ 116 which is also fed back to an input of the source follower 110.

The voltage multiplier 106 increases the input voltage to a desired level suitable for efficiently driving the switching transistor 112. In one embodiment, a voltage tripler comprises the multiplier 106, such that the output of the voltage multiplier 106 is appropriately three times the level of the signal provided from the low-voltage input 102.

The level shifter 108 shifts logic level signals, received from the switching control input 104 at the low-voltage supply level, to an output signal having a form similar to the logic signal, that is at a voltage level proportional to the output of the voltage multiplier 106. This output signal from the level shifter 108 is communicated to the source follower 110, which utilizes a high voltage signal from the switching power supply 114 to increase the current level of the signal received from the level shifter 108. Thus, the voltage multiplier 106 needs to provide only a small amount of current through the level shifter 108 into a high impedance gate of the source follower 110, while the source follower 110 provides a much larger current to drive the gate of the switching transistor 112. The switching transistor 112 can then control the switching of the switching power supply 114 using the logic signal received from the source follower 110. Such a circuit addresses the problem described above of providing a signal of sufficient voltage and current level in an application using a low voltage input.

Although the power conversion switching transistor 112 is shown in FIG. 1 as controlling the switching power supply 114, alternative types of boost converter switching power supplies can also be used.

Figure 2:
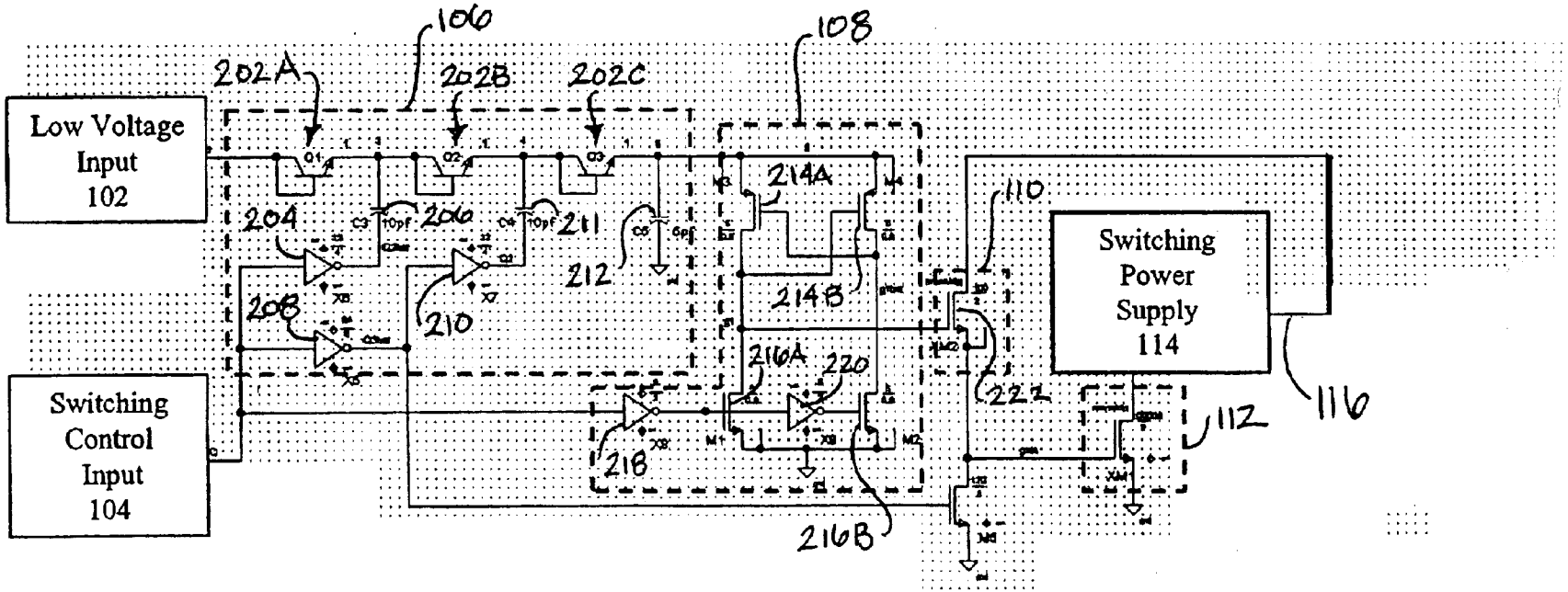
FIG. 2 is a schematic diagram of the charge pump active gate drive of FIG. 1.

FIG. 2 is a schematic diagram of one embodiment of a circuit implementation of the block diagram of FIG. 1. In the circuit of FIG. 2, the voltage multiplier 106 is a diode tripler, implemented using three bipolar junction transistors (BJT) Q1, Q2, Q3, 202A–C connected in series, where the collector is shorted to the base on each BJT 202A–C. The diode tripler 106 receives a signal from the low-voltage input 102 at an input of the first BJT Q1 202A. An output logic signal from the switching control input 104 is received at a first logic inverter 204, which is connected to a first capacitor 206 in series, and the capacitor is connected to the emitter of BJT Q1 202A. The logic signal from the switching control input 104 is also received at a second inverter 208, which is connected in series with a third inverter 210, followed by a second capacitor 211 which is connected to the emitter of BJT Q2 202B. Additionally, a third capacitor 212 is connected between the emitter of BJT Q3 202C and ground.

In operation, the BJT's 202A–C and capacitors 206, 211, 212 perform similar to diode half-wave rectifier circuits using the logic signal from the switching control input 104. The inverters 204, 208, 210 provide appropriate cycle timing to turn the BJT's on and off and, thus, charge and discharge the three capacitors 206, 211, 212 so as to produce a voltage signal at the emitter of BJT Q3 202C three times the level of the voltage signal received from the low voltage input.

The level shifter 108 of FIG. 2 comprises a pair of PMOS transistors M3 214A and M4 214B connected with a shared source input from the emitter of BJT Q3 202C. The gate of M3 214A is connected to the drain of M4 214B and the gate of M4 214B is connected to the drain of M3 214A. The level shifter also comprises a pair of NMOS transistors M1 216A and M2 216B. The drain of M3 214A is connected to the drain of M1 216A, and the drain of M4 214B is connected to the drain of M2 216B. The gate of M1 receives an input signal from the switching control input 104 through a fourth inverter 218, and the gate of M2 receives an input signal from the gate of M1 through an additional fifth inverter 220. The switching control input 104 and the fourth and fifth inverters 218, 220 provide non-overlapping drive signals to the NMOS transistors M1 216A and M2 216B. The source of each NMOS transistor M1 216A and M2 216B is connected to ground. The cross-coupled PMOS transistors, M3 214A and M4 214B, provide the differential amplification to produce higher level logic signals at the voltage level of the output signal of the voltage multiplier 106. The level shifter 108 thereby shifts the output signal of the switching control input 104 to a level proportional to the signal produced at the output of the voltage multiplier 106 so as to more efficiently operate the switching transistor 112.

The source follower 110 of FIG. 2 comprises a high impedance NMOS transistor XM2 222 having a gate input from the drain of M1 216A of the level shifter 108, and a drain input from the high voltage output 116 of the boost converter switching power supply 114. The source output of XM2 222 is connected to the gate of the power switching transistor XM1 112. The drain of XM1 112 is connected to the input of the boost converter switching power supply 114, and the source of XM1 112 is connected to ground.

The source follower 110 receives the shifted logic signal from the level shifter 108, which has a voltage level higher than the low voltage input, at the gate of the transistor XM2 222. The current at the source of the transistor XM2 222 is a function of a product of the voltage at the drain and the voltage at the gate of the transistor. Therefore, by employing the high voltage signal from the output 116 of the switching power supply 114, the source follower effectively increases the current of the shifted logic signal, and applies the shifted logic signal to the power switching transistor 112.

In operation, the circuit of FIG. 2 receives a signal from a low voltage input 102, of about 2.7V, and a logic signal from a switching control input 104. The diode tripler 106 triples the low-voltage input 102. The level shifter 108 converts the logic level signals from the switching control input 104 at the low-voltage supply level and provides the converted voltage signal to the high impedance source follower 110. The source follower 110 drives the gate of the power conversion switching transistor 112 according to the logic signal input from the level shifter 108 by employing the high current source of the high voltage output 116 of the boost converter switching power supply 114.

The diode tripler 106 only needs to provide a small current into the high impedance gate of the source follower 110, while the source follower 110 provides a much larger current to drive the gate of the power switching transistor 112. Since the current needed to drive the gate of the source follower 110 can be as much as 10,000 times less than the current needed to drive the gate of the power switching transistor 112, the design of the circuit of FIG. 2 offers significant power gain between the low voltage input 102 and the power transistor 112. Therefore, the capacitors 206, 211, and 212 comprising the diode tripler 106 can be proportionally smaller in value and size which allows them to be integrated onto an integrated chip rather than supplied as external components.

A smaller and less expensive switching transistor 112 can be used in the design of the switching power supply 114 since higher gate drive voltages translate to lower on-resistance in the switching transistor 112, therefore a smaller transistor can be used for the switching transistor 112. By increasing the voltage level provided from the low voltage source, such as batteries, a high enough control voltage is supplied to the switching transistor so as to achieve a low on resistance and acceptable power conversion in the circuit without increasing the size of the power transistor.

In view of the above, it will be appreciated that an appropriate apparatus and method for increasing the voltage supply level while minimizing losses and maintaining an effective die size has been disclosed for power conversion circuits used with small voltage supplies.

Specific parts, shapes, materials, functions and modules have been set forth, herein. However, a skilled technologist will realize that there are many ways to fabricate the system of the present invention, and that there are many parts, components, modules or functions that may be substituted for those listed above. While the above detailed description has shown, described, and pointed out the fundamental novel features of the invention as applied to various embodiments, it will be understood that various omissions, substitutions, and changes in the form and details of the components illustrated may be made by those skilled in the art, without departing from the spirit or essential characteristics of the invention.

What is claimed is:

1. A drive circuit for increasing the voltage and current level of at least one of a first voltage input signal and a logic signal, comprising:

a voltage multiplier configured to increase the level of said first voltage input signal so as to define a multiplied voltage signal;

a level shifting circuit configured to shift a level of said logic signal to a level related to said multiplied voltage signal to produce a shifted, multiplied voltage signal; and a device, connected to a voltage source, and configured to increase the current level of said shifted, multiplied voltage signal.

2. The drive circuit of claim 1, wherein a voltage level of said voltage source is substantially higher than the voltage level of said first voltage input signal.

3. The drive circuit of claim 1, wherein said device for increasing the current level of said shifted, multiplied voltage signal is a source follower MOSFET.

4. The drive circuit of claim 1, wherein said device is configured to drive a gate of a power switching transistor.

5. The drive circuit of claim 1, wherein said voltage multiplier is a diode tripler.

6. A drive circuit, comprising:

a low voltage input;

a switching control input;

a voltage input;

a voltage multiplier connected to said low voltage input and said switching control input, said voltage multiplier configured to increase a voltage level of a signal received from said low voltage input so as to define a multiplied voltage signal;

a level shifter connected to said voltage multiplier and said switching control input and configured to shift a level of a logic signal received from said switching control input to define a shifted logic signal having a voltage level related to the increased voltage level of said multiplied voltage signal;

a source follower, connected to said level shifter and said voltage input and configured to increase the current level of said shifted logic signal received from said level shifter so as to produce a modified, shifted logic signal; and a power transistor, responsive to said modified, shifted logic signal.

7. The circuit of claim 6, wherein said voltage multiplier is a tripler.

8. The circuit of claim 7, wherein said tripler is a diode tripler.

9. The circuit of claim 7, wherein said diode tripler comprises:

a first bipolar junction transistor having a collector shorted to a base, and a collector input from said low voltage input;

a first capacitor connected to said switching control input through a first inverter, and to an emitter of said first bipolar junction transistor;

a second bipolar junction transistor having a collector shorted to a base, and a collector input connected to said emitter of said first bipolar junction transistor;

a second capacitor connected to said switching control input through a second inverter in series with a third inverter, and to an emitter of said second bipolar junction transistor;

a third bipolar junction transistor having a collector shorted to a base, and a collector input connected to said emitter of said second bipolar junction transistor; and a third capacitor connected to an emitter of said third bipolar junction transistor and ground so as to triple the level of said signal from said low voltage input.

10. The circuit of claim 6, wherein said level shifter comprises:

a first PMOS transistor in parallel with a second PMOS transistor, having a common input from said voltage multiplier, wherein a gate of said first PMOS transistor is connected to a drain of said second PMOS transistor, and a gate of said second PMOS transistor is connected to a drain of said first PMOS transistor;

a first NMOS transistor having a drain input from said drain of said first PMOS transistor, a gate input from said switching control input through a fourth inverter, and a source connected to ground;

a second NMOS transistor having a drain input from said drain of said second PMOS transistor, and a gate input from said gate of said first NMOS transistor through a fifth inverter, and a source connected to ground; and an output connected to said drain of said first PMOS transistor so as to shift said level of said logic signal to a level of said output of said voltage multiplier.

11. The circuit of claim 6, wherein said source follower comprises an NMOS transistor having a gate input from said level shifter, a drain input from said second voltage input, and a source output to said power transistor.

12. The circuit of claim 6, implemented in a voltage regulator circuit.

13. The circuit of claim 6, implemented in a portable display device.

14. A drive circuit, comprising:

a low voltage input;

a switching control input;

a second voltage input;

a voltage multiplier responsive to said low voltage input and said switching control input, and configured to increase the level of said low voltage input signal so as to define a multiplied voltage signal;

a level shifter responsive to said voltage multiplier and said switching control input, and configured to shift a low voltage level of said switching control input to a voltage level related to said multiplied voltage signal to produce a shifted, multiplied voltage signal;

a source follower responsive to said level shifter and to a signal from said second voltage input, said source follower configured to increase the current level of said shifted, multiplied voltage signal so as to produce a modified, shifted voltage signal;

a power transistor having a gate drive input from said source follower and responsive to said modified, shifted voltage signal.

15. A drive circuit for driving the gate of a power transistor from a low voltage input, comprising:

a switching control input;

a second voltage input;

a voltage multiplier connected to said low voltage input and said switching control input, and configured to increase the signal level of said low voltage input so as to define a multiplied voltage signal;

a level shifter connected to said voltage multiplier and said switching control input, and configured to shift a low voltage signal level of said switching control input to that of said multiplied voltage signal to produce a shifted, multiplied voltage signal;

a source follower connected to said level shifter and said second voltage input, said source follower configured to increase the current level of said shifted, multiplied voltage signal so as to produce a modified, shifted voltage signal; and a power transistor having a gate drive input from said source follower and responsive to said modified, shifted voltage signal.

16. The drive circuit of claim 15, wherein said voltage multiplier is a diode tripler.

17. The drive circuit of claim 15, wherein said diode tripler comprises:

a first bipolar junction transistor having a collector shorted to a base, and a collector input from said low voltage input;

a first capacitor connected to said switching control input through a first inverter, and to an emitter of said first bipolar junction transistor;

a second bipolar junction transistor having a collector shorted to a base, and a collector input connected to said emitter of said first bipolar junction transistor;

a second capacitor connected to said switching control input through a second inverter in series with a third inverter, and to an emitter of said second bipolar junction transistor;

a third bipolar junction transistor having a collector shorted to a base, and a collector input connected to said emitter of said second bipolar junction transistor; and a third capacitor connected to an emitter of said third bipolar junction transistor and ground.

18. The drive circuit of claim 15, wherein said level shifter comprises:

a first PMOS transistor in parallel with a second PMOS transistor, wherein a gate of said first PMOS transistor is connected to a drain of said second PMOS transistor, and a gate of second PMOS transistor is connected to a drain of said first PMOS transistor;

a first NMOS transistor having a drain input from said drain of said first PMOS transistor, a gate input from said switching control input through a fourth inverter, and a source connected to ground;

a second NMOS transistor having a drain input from said drain of said second PMOS transistor, and a gate input from said gate of said first NMOS transistor through a fifth inverter, and a source connected to ground; and an output connected to said drain of said first PMOS transistor.

19. The drive circuit of claim 15, wherein said source follower comprises an NMOS transistor having a gate input from said level shifter, a drain input from said power switching supply, and a source output to said power transistor.

20. The drive circuit of claim 15, implemented in a portable display device.

21. A drive circuit for increasing the voltage level and current level of a low voltage input signal and a logic input signal, comprising:

means for multiplying said low voltage input signal to produce a multiplied voltage signal;

means for shifting said logic input signal to a voltage level related to said multiplied voltage signal, so as to produce a shifted, multiplied voltage signal; and means for increasing the current of said shifted, multiplied voltage signal, in response to a high voltage power source.

22. The drive circuit of claim 21, wherein said means for multiplying said low voltage input signal comprises a diode tripler.

23. The drive circuit of claim 21, wherein said means for shifting said logic input signal comprises a level shifter.

24. The drive circuit of claim 21, wherein said means for increasing the current of said shifted, multiplied voltage signal comprises a source follower transistor.

25. A drive circuit for providing a gate drive voltage to a power transistor from a low voltage input, said method comprising:

means for providing a switching control input;

means for multiplying a signal from said low voltage input using a signal from said switching control input, a diode tripler, and at least one capacitor so as to produce a multiplied voltage signal;

means for level shifting said multiplied voltage signal using said signal from said switching control input;

means for bootstrapping a high voltage power supply to a source follower;

means for providing a first current to said source follower; and means for providing a second current from said source follower to said power transistor.

26. The drive circuit of claim 25, wherein a level of said second current is substantially higher than a level of said first current.

27. The drive circuit of claim 25, wherein said means for multiplying said signal from said low voltage input is a diode tripler.

28. The drive circuit of claim 27, wherein said diode tripler comprises a plurality of capacitors.

29. The drive circuit of claim 25, wherein said power transistor is a power MOSFET.

30. A method of increasing the voltage level and current level of a low voltage logic signal using a first voltage source, said method comprising:

multiplying a first voltage signal from said first voltage source to produce a multiplied voltage signal;

shifting said low voltage logic signal to the voltage level of said multiplied voltage signal; and increasing the current of said shifted, multiplied voltage signal, by use of a bootstrap connection to a second voltage source.

31. The method of claim 30, wherein a voltage level of said second voltage source is substantially higher than the voltage level of said first voltage source.

32. The method of claim 30, wherein the act of multiplying is performed by a diode tripler.

33. The method of claim 30, wherein the act of increasing the current of said shifted, multiplied voltage signal is performed by a source follower transistor.

34. A method of providing a gate drive voltage to a power transistor from a low voltage input, said method comprising:

providing a switching control input;

multiplying said low voltage input using said switching control input, a diode tripler, and at least one capacitor;

level shifting said multiplied low voltage input using said switching control input;

bootstrapping a high voltage switching power supply to a source follower;

providing a first current to said source follower; and providing a second current from said source follower to said power transistor.

35. The method of claim 34, wherein a level of said second current is substantially higher than a level of said first current.

36. The method of claim 34, wherein the act of multiplying is performed by a diode tripler.

37. The method of claim 34, wherein said diode tripler comprises a plurality of capacitors.

38. The method of claim 34, wherein said power transistor is a power MOSFET.

* * * * *

UNITED STATES PATENT AND TRADEMARK OFFICE

CERTIFICATE OF CORRECTION

PATENT NO. : 6,828,850 B2
DATED : December 7, 2004
INVENTOR(S) : Lechevalier

It is certified that error appears in the above-identified patent and that said Letters Patent is hereby corrected as shown below:

Title page,
Item [56], References Cited, FOREIGN PATENT DOCUMENTS, after "GB" delete "2 239 638 A" and insert -- 2 339 638 A --.

Signed and Sealed this

Twenty-eighth Day of March, 2006

JON W. DUDAS
*Director of the United States Patent and Trademark Office*